US009087654B2

(12) United States Patent
Nahata et al.

(10) Patent No.: US 9,087,654 B2
(45) Date of Patent: Jul. 21, 2015

(54) ARC CHUTE ARRANGEMENT FOR ARC QUENCHING IN ELECTRICAL SWITCHING DEVICE

(71) Applicant: Larsen & Toubro Limited, Mumbai (IN)

(72) Inventors: Deepak Nahata, Mumbai (IN); Jibanesh Roy, Mumbai (IN); Deepak M. Ochani, Mumbai (IN)

(73) Assignee: Larsen & Toubro Limited, Mumbai (IN)

( * ) Notice: Subject to any disclaimer, the term of this patent is extended or adjusted under 35 U.S.C. 154(b) by 176 days.

(21) Appl. No.: 13/693,167

(22) Filed: Dec. 4, 2012

(65) Prior Publication Data

US 2014/0151340 A1 Jun. 5, 2014

(51) Int. Cl.

| | |
|---|---|
| ***H01H 83/00*** | (2006.01) |
| ***H01H 9/30*** | (2006.01) |
| ***H01H 9/34*** | (2006.01) |
| ***H01H 9/36*** | (2006.01) |

(52) U.S. Cl.

CPC ..... *H01H 9/302* (2013.01); *H01H 9/345* (2013.01); *H01H 9/362* (2013.01); *H01H 2009/365* (2013.01); *H01H 2009/367* (2013.01)

(58) Field of Classification Search

CPC ..... H01H 77/108; H01H 73/18; H01H 1/54

USPC ..... 218/34, 25, 148

See application file for complete search history.

(56) References Cited

U.S. PATENT DOCUMENTS

| | | | | | |
|---|---|---|---|---|---|
| 2,713,101 | A * | 7/1955 | Young | 218/34 |
| 2,911,505 | A * | 11/1959 | Legg et al. | 218/149 |
| 3,728,503 | A * | 4/1973 | Clausing et al. | 218/149 |
| 4,375,021 | A * | 2/1983 | Pardini et al. | 218/25 |
| 4,405,847 | A * | 9/1983 | Morton | 218/149 |
| 4,609,797 | A * | 9/1986 | Morton et al. | 218/151 |
| 4,743,720 | A * | 5/1988 | Takeuchi et al. | 218/24 |
| 4,752,660 | A * | 6/1988 | Yokoyama et al. | 218/117 |
| 4,761,626 | A * | 8/1988 | Teraoka | 335/16 |
| 4,876,421 | A * | 10/1989 | Miller et al. | 218/150 |
| 6,222,147 | B1 * | 4/2001 | Doughty et al. | 218/157 |
| 6,248,970 | B1 * | 6/2001 | DiMarco et al. | 218/149 |
| 2005/0263492 | A1 * | 12/2005 | McCoy | 218/34 |
| 2009/0255904 | A1 | 10/2009 | Andre et al. | |

* cited by examiner

*Primary Examiner* — Truc Nguyen

(74) *Attorney, Agent, or Firm* — The Webb Law Firm

(57) ABSTRACT

An arc chute arrangement for arc quenching in electrical switching device, said arrangement comprising a plurality of deion plates, each said deion plates further comprising a pair of plates having an ablative material sandwiched therebetween; a lining means for holding said deion plates; wherein said deion plates having a chamfered profile at one corner to generate high magnetic field that drive the arc inside arc chute and said chamfered profile arranged alternatively thereby substantially lengthening the arc.

7 Claims, 5 Drawing Sheets

*i : Short circuit fault current*
*F : Lorentz's force exerted on arc*
*L : Increased length of current path per metal plate*
*T : Thickness of the deion plate (single metal plate construction)*

ARC CHUTE ARRANGEMENT FOR ARC QUENCHING IN ELECTRICAL SWITCHING DEVICE

BACKGROUND OF THE INVENTION

1. Field of the Invention

The present invention relates generally to electrical switching devices. More particularly the invention relates to an arc chute arrangement for arc quenching in electrical switching devices.

2. Description of Related Art

Conventional Circuit Breaker consists of housing and cover made up of insulating material, pair of separable contacts enclosed within the housing, cover and arc quenching device known as Arc chute. The switching arc in circuit breaker and its motion are determined by the intensity of current, electromagnetic from arc chute as well as the gas-dynamic process within the arc chute.

The arc chute consists of stack of deion plates made up of magnetic material to attract, split-up & cool the arcs. The stack of deion plates is trapped in between two plates known as lining made up of electrically insulating material. The function of deion plates is to split the arc in several series arcs of approximately equal length which will result in higher arc voltage and distinctly greater dielectric strength after current zero.

Some of the prior arts in the related field of invention are as follows:

U.S. Pat. No. 4,375,021 provides a rapid arc extinguishing assembly includes an arc chute comprising a large number of essentially parallel deion plates each in form of thin magnetically permeable, electrically conductive plates bent in U-shape, with the curve of the U facing the circuit breaker contacts and the arms thereof insulated from each other by a thin insulation sheet. To promote arc extinction by the arc chute and accelerated breaker contact separation, the breaker contacts are flanked by a magnetic assembly comprising opposed columns of parallel, spaced ferromagnetic plates embedded in an insulating material. The columns may be magnetically coupled by a yoke to create a closed slot in which the breaker movable contact travels.

US2009255904 provides an arc splitter arrangement for an electrical switch comprises at least two arc splitters composed of a ferromagnetic material disposed parallel to one another, wherein each of the at least two arc splitters has a V-shaped cutout on a narrow face edge forming an inlet area for an arc, and an insulating material at least partially coating at least one side of the arc splitter, wherein the at least one side includes an area located behind the inlet area in an arc running direction, the area being free of, and surrounded by, the insulating material. A service switching device comprises at least one arc splitter arrangement.

In the conventional deion plate construction (single metal plate) the arc root forms on both side of the deion plate, in presented construction of deion plate assembly (ablative material sandwiched between two metal plates) the arc root forms only on one side of the metal plate which results in less erosion of deion plate assembly and hence ensures the faster quenching of arc in subsequent short circuit faults.

The current invention makes use of ablative material (gassing material) near arcing zone in such a way that the electronegative gasses released by the ablative material absorb the charged particles from arc thereby reducing the intensity of ions in the arcing zone which increase the dielectric strength of the region. With increase in dielectric strength of the arcing region the arc quenching becomes faster.

In conventional arc chute assembly there is possibility that the arc can flash over or re-strike at the end of the deion plate stack or else on the side edges, thus preventing arc voltage build up and correct short circuit disconnection. In conventional arc chute assembly during arc interruption, the molten material gets deposited at the side edges of the deion plate and forms a current path by connecting deion plates by bridging the gap between them at side edges. This current path formed due to molten material reduces the effectiveness of arc quenching process and results in arc flash over or restrike. In presented construction of deion plate assembly, deion plates have a chamfered profile at one corner. The molten material gets deposited at the ends of deion plates and forms conductive bridge between consecutive deion plates. In present construction, the gap between two consecutive edges is twice the gap between two deion plates of conventional arc chute. Thereby the possibility of flash-over arc restrike is minimized. At the same time chamfer profile generates high magnetic field that drive the arc inside arc chute and said chamfered profile arranged alternatively thereby substantially lengthening the arc.

In view of the above disadvantages of the prior art the present inventors have designed the deion plate assembly of the present invention so that it provides faster build up of dielectric strength, due to use of ablative material and higher voltage drop across deion plate assembly, due to the increased length of current path, as compared to conventional deion plates (single metal plate construction) wherein the voltage drop across deion plate depends on the thickness and material used for the deion plate. This invention is related to the arrangement of deion plates used in arc chute of an electrical switching devices such as circuit breaker, a motor circuit breaker or contactor. The deion plate consists of stack assembly of ablative material sandwiched in between two electrically connected metal plates.

OBJECTS OF THE INVENTION

A basic object of the present invention is to overcome the disadvantages/drawbacks of the known art.

Another object of the present invention is to provide an arc chute arrangement for arc quenching in electrical switching device.

Another object of the present invention is to provide faster arc quenching.

Another object of the present invention is to provide for optimum use of ablative material.

Yet another object of the present invention is to minimize the possibility of flash over or re-strike.

These and other advantages of the present invention will become readily apparent from the following detailed description read in conjunction with the accompanying drawings.

SUMMARY OF THE INVENTION

The following presents a simplified summary of the invention in order to provide a basic understanding of some aspects of the invention. This summary is not an extensive overview of the present invention. It is not intended to identify the key/critical elements of the invention or to delineate the scope of the invention. Its sole purpose is to present some concept of the invention is a simplified form as a prelude to a more detailed description of the invention presented later.

There is provided arc chute arrangement for arc quenching in electrical switching device.

According to one aspect of the present invention, there is provided arc chute arrangement for arc quenching in electrical switching device, said arrangement comprising a plurality of deion plates, each said deioni plates further comprising a pair of plates, electrically connected to each other, having an ablative material sandwiched there between; a lining means for holding said deion plates; wherein said deion plates having a chamfered profile at one corner to minimize the possibility of flash-over arc restrike and to generate high magnetic field that drive the arc inside arc chute and said chamfered profile arranged alternatively thereby substantially lengthening the arc.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The following drawings are illustrative of particular examples for enabling methods of the present invention, are descriptive of some of the methods, and are not intended to limit the scope of the invention. The drawings are not to scale (unless so stated) and are intended for use in conjunction with the explanations in the following detailed description.

Persons skilled in the art will appreciate that elements in the figures are illustrated for simplicity and clarity and may have not been drawn to scale. For example, the dimensions of some of the elements in the figure may be exaggerated relative to other elements to help to improve understanding of various exemplary embodiments of the present disclosure.

Throughout the drawings, it should be noted that like reference numbers are used to depict the same or similar elements, features, and structures.

DESCRIPTION OF THE PREFERRED EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Accordingly in the present invention an improved arc chute assembly for arc quenching in an electrical switching device is provided.

Figure 1:
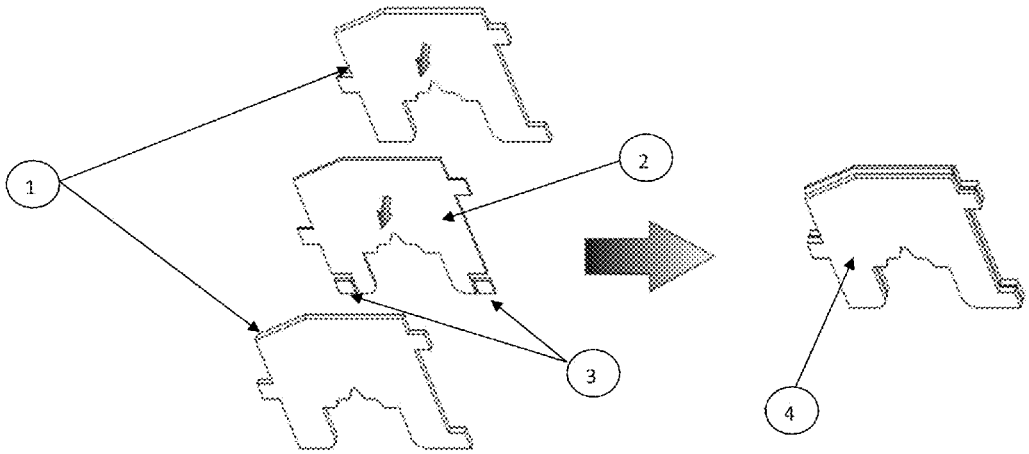
FIG. 1 illustrates the Single Deion plate sub-assembly (sandwich construction).
Figure 2:
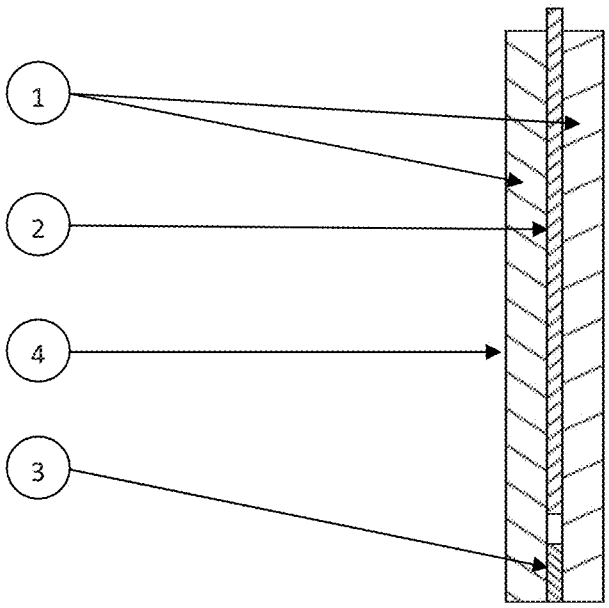
FIG. 2 illustrates Cross section view of Single Deion plate sub-assembly.
Figure 3:
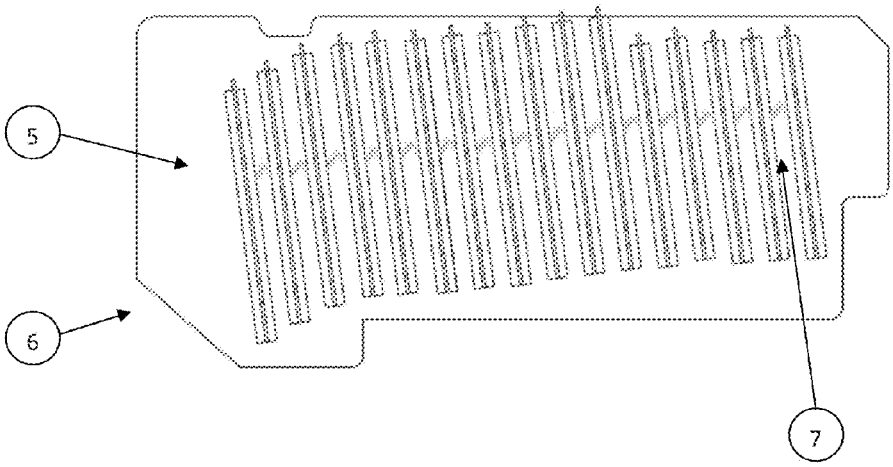
FIG. 3 illustrates Arc chute assembly.

The deion plate consist of stack assembly (4) of ablative material (2) sandwiched in between two metal plates (1) made up of ferromagnetic material. The metal plate (1) may be coated with suitable electrically conducting and or magnetic material to provide higher arc mobility. These two metal plates are connected electrically with each other by means of any process say welding done on both sides of the deion plates as shown in FIGS. 1 and 2. Deion plates can be joined through a high resistance material. The joining can be either plain welding of two components or it can be joined through the high resistance material.

In the present construction of deion plate assembly (ablative material sandwiched between two metal plates) the arc root forms only on one side of the metal plate which results in less thermal stresses compare to conventional deion plates and less erosion of deion plate assembly and hence ensures the faster quenching of arc in subsequent short circuit faults. The ablative material (2) generates gasses exactly near the arc roots resulting in rapid buildup of dielectric strength of arcing region and faster cooling of arc. This reduces the severity of arcing which results in faster arc quenching and lesser erosion of deion plates.

The ablative material (2) is sandwiched in between two metal plates (1) as shown in FIG. 2. During short circuit fault after separation of main contacts the arc moves towards the arc chute (6) because of magnetic pull produced by deion plate assemblies. The deion plates pull the arc (7) into the arc chute where it loses its heat energy and splits in several series arcs. The heat energy released from arc heats ablative material causing expulsion of electronegative gasses which absorbs the charged particles from arc, assist in deionization of arcing zone and further increases gap resistance, cools the arc and increases the gas velocity which helps in faster penetration of are inside the are chute. As the ablative material is sandwiched in between two metal plates the ablation takes place exactly near the arc roots formed on the deion plates. This helps in rapid recovery of dielectric strength of arcing zone and hence lesser arc splitting time.

Figure 4A:
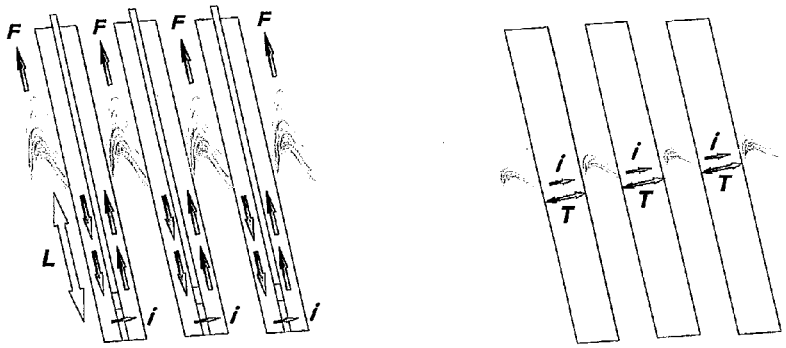
FIG. 4A and FIG. 4B illustrate Magnetic blast effect in arc chute.

In deion plate stack assembly two metal plates are connected electrically to each other at the bottom ends (FIG. 4). This construction provides higher voltage drop across deion plate assembly, due to the increased length of current path, as compared to conventional deion plates (single metal plate construction) wherein the voltage drop across deion plate depends on the thickness of deion plates and material of deion plate.

The current direction in second metal plate is opposite to that of first metal plate of the next deion plate sub-assembly (FIG. 4). This Current loop generates electromagnetic force which acts on the arc in upward direction and pushes it further inside the arc chute. Thus resulting in increase in effective magnetic pull on the arc and faster penetration of arc inside arc chute and hence less arc splitting time which ultimately results into faster arc quenching.

In the present invention the arc chute assembly is improved upon by means of deion plate arrangement wherein the one corner of the deion plate profile is chamfered and the deion plates are arranged in way such that the chamfered profiles will fall in an alternate direction. This results in a zigzag splitting of the arc as it enters the arc chute which lengthens it further and increases the arc resistance along with splitting which helps in faster quenching of the arc. Faster quenching of the arc results in lower arcing times which limits the fault current and lowers the let through energy/stresses passed on to the downstream devices.

During short circuit fault, after contact separation arc enters inside the arc chute, it splits in number of smaller series arcs. The fault current flowing through the circuit produces a magnetic field in deion plates. Magnetic field lines passing through deion plates produces a pulling force (attraction force) on the arc which drives it further inside the arc chute. The magnitude and direction of the pulling force acting on the arc depends on the magnetic flux density and its distribution in the deion plates. The force acting on arc due to the gas pressure generated inside the arcing chamber also pushes the arc further inside the arc chute.

Figure 5A:
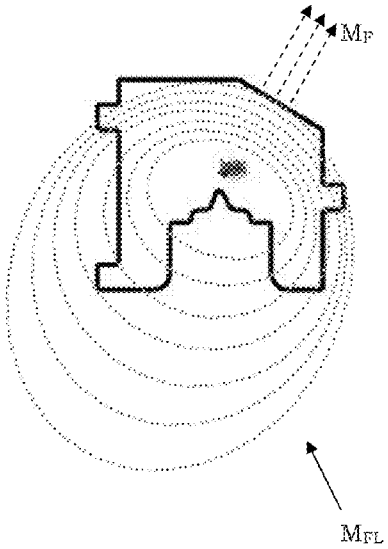
FIG. 5A and FIG. 5B illustrate Magnetic flux distribution in deion plate and gas flow.
Figure 5B:
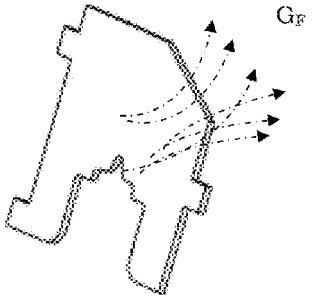

Moreover, deion plates have a chamfer profile (8) on one side which results in crowded magnetic flux lines ($M_{FL}$) in that region. This results in higher magnetic flux density in that region compared to any other region of the deion plate. This is depicted in FIG. 5A. The arc (7) thus experiences maximum magnetic force in the direction of chamfered profile of deion plate. Also the hot gases produced due to arc plasma experience lesser opposition while escaping out from the chamfered profile which increases the gas flow in that region as shown in FIG. 5B. Thus the force acting on the arc due to gas dynamics pushes arc towards the chamfered profile of the deion plate.

Figure 4B:
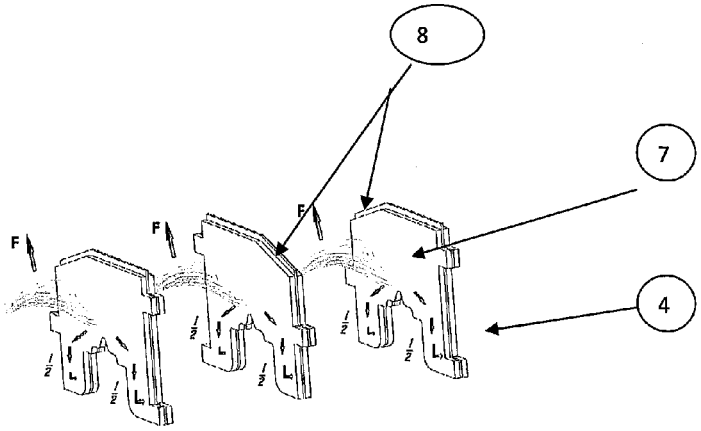

As shown in FIG. 4B, deion plates are arranged such that the chamfered profile (8) of the deion plate falls in an alternate direction. The combined effect of magnetic force ($M_F$) and gas dynamic force ($G_F$) pushes the arc root towards chamfered profile of the splitter plate and thus causing lengthening of the arc inside the splitter plates in a zig-zag way. This also helps in faster cooling of arc.

In present invention the deion plates are arranged such that the chamfered profile of the deion plate falls in an alternate direction. The chamfer profile of deion plate and deion plate stack arrangement minimizes the possibility of molten material bridge formation between deion plates and thus prevents the possibility of restrike.

PART AND FEATURE INDEX

1. Metal plate
2. Ablative material
3. Resistive means
4. Deion plate stack assembly
5. Lining means
6. Arc chute assembly
7. Electric arc
8. Chamfered Profile The advantage of using stack of deion plates having ablative material deion plates is:

1) Optimum use of ablative material.

2) Ablative material will emit gasses only under the event of very high temperature condition i.e. during short circuit.

3) Rapid voltage build up of the arc due to presence of high resistance material in between two deion plates.

4) Rapid voltage build up of the arc due to ablative material assisting in dielectric strength build up.

5) Rapid penetration of arc inside the arc chute because of magnetic blast effect generated due to current flow in parallel deion plates.

6) During short circuit the arc enters inside the deion plate stack assembly and splits in series of small arcs. These small arcs forms anode and cathode arc roots on deion plates. The anode and cathode arc roots have different arc mobility. Use of two deion plates made up of different materials for deion plate stack assembly will result in higher arc mobility of anode and cathode arc root. In present invention deion plates of two dissimilar metals are connected mechanically and electrically to form deion plate stack assembly. So for DC switching, by using deion plates of two different metals or deion plates with different coatings connected in such a way that the DC arc can be quenched faster.

This system ultimately results into swift movement of arc inside the arc chutes, due to heat generated during arcing inside the arc chutes, the ablative material will generate gasses which will assist in deionization of the arcing zone. This helps in rapid dielectric recovery. This all will result into higher arc voltage and hence the arc quenching will be faster.

Although the embodiments herein are described with various specific embodiments, it will be obvious for a person skilled in the art to practice the embodiments herein with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

We claim:

1. An arc chute arrangement for arc quenching in electrical switching device, said arrangement comprising:

a plurality of deion plates, each said deion plates further comprising at least a pair of plates joined through a resistive element and having an ablative material sandwiched therebetween;

a lining for holding said deion plates;

wherein said deion plates are made of same ferromagnetic material or optionally made of different magnetic materials to provide substantially high arc running capacity and wherein said deion plates comprising chamfered profile at its one corner generating high magnetic field that drive the arc inside arc chute and said chamfered profile of two consecutive deion plates being arranged in an alternative relationship forming a zig zag path for the arc resulting in substantially lengthening of the arc.

2. Arrangement as claimed in claim 1 wherein said lining is made of substantially electrically insulating material.

3. Arrangement as claimed in claim 1 wherein said resistive element being adapted to establish electrical connection between a pair of plates.

4. Arrangement as claimed in claim 1 wherein said ablative material is configured to release electronegative gases during short circuit whereby said electronegative gases absorb charged particles from the arc.

5. Arrangement as claimed in claim 1 wherein said deion plates are placed in substantial parallel configuration to generate magnetic blast effect during current flow.

6. Arrangement as claimed in claim 1 wherein said deion plates configured to generate current loop thereby exerting force on the arc.

7. Arrangement as claimed in claim 1 wherein said deion plates along with ablative material arranged together forming a stack assembly.

* * * * *